US010152877B2

(12) United States Patent
Linder et al.

(10) Patent No.: US 10,152,877 B2
(45) Date of Patent: Dec. 11, 2018

(54) SYSTEMS AND METHODS FOR ADAPTIVE DETECTION OF AUDIO ALARMS

(71) Applicant: SCHNEIDER ELECTRIC IT CORPORATION, West Kingston, RI (US)

(72) Inventors: Stephen Paul Linder, Medford, MA (US); Jeffrey Steven Young, Billerica, MA (US)

(73) Assignee: SCHNEIDER ELECTRIC IT CORPORATION, West Kingston, RI (US)

( * ) Notice: Subject to any disclaimer, the term of this patent is extended or adjusted under 35 U.S.C. 154(b) by 0 days.

(21) Appl. No.: 14/996,577

(22) Filed: Jan. 15, 2016

(65) Prior Publication Data

US 2017/0206776 A1 Jul. 20, 2017

(51) Int. Cl.
*G08B 29/10* (2006.01)
*G08B 1/08* (2006.01)
*G08B 3/10* (2006.01)

(52) U.S. Cl.
CPC ..... *G08B 29/10* (2013.01); *G08B 1/08* (2013.01); *G08B 3/10* (2013.01)

(58) Field of Classification Search
USPC ..... 340/506
See application file for complete search history.

(56) References Cited

U.S. PATENT DOCUMENTS 347,184 A 8/1886 Maloney
2,229,198 A 1/1941 Zale
5,710,715 A * 1/1998 Shitanda ..... G01H 1/003 702/56
6,714,977 B1 3/2004 Fowler et al.
8,917,186 B1 12/2014 Grant
9,230,367 B2 * 1/2016 Stroila ..... G06T 11/60
9,503,873 B1 * 11/2016 Yadav ..... H04W 4/22
2004/0145465 A1 7/2004 Stults et al.
2006/0017558 A1 * 1/2006 Albert ..... A61B 7/003 340/531
2006/0017559 A1 1/2006 Albert
2006/0017560 A1 * 1/2006 Albert ..... G08B 1/08 340/531

(Continued)

OTHER PUBLICATIONS

Website "Kidde Remote Lync", Kidde United Technologies, Kiddie 2016, 4 pgs.; retrieved from http://remotelync.kidde.com.

(Continued)

*Primary Examiner* — Fekadeselassie Girma

(74) *Attorney, Agent, or Firm* — Lando & Anastasi, LLP

(57) ABSTRACT

Systems and methods are provided for the adaptive detection of audio alarms. A system comprises a microphone configured to receive a series of sounds, a memory configured to store a defined set of alarm templates, a communications network interface, and a processor. The processor is configured to receive and analyze sounds for alarm or background sound characteristics and compare them to a defined set of alarm templates stored in the memory. If not contained in the defined set of alarm templates previously stored in the memory, new alarm templates are learned and stored. An alert is then transmitted to a client device that an audio alarm has been recognized.

17 Claims, 7 Drawing Sheets

(56) References Cited

U.S. PATENT DOCUMENTS

| | | | | |
|---|---|---|---|---|
| 2006/0017561 | A1* | 1/2006 | Albert | G08B 17/00 340/531 |
| 2006/0114314 | A1* | 6/2006 | Dunko | H04B 1/3833 348/14.1 |
| 2006/0250260 | A1* | 11/2006 | Albert | G06F 19/3418 340/628 |
| 2010/0177193 | A1* | 7/2010 | Flores | G08B 13/126 348/148 |
| 2010/0195447 | A1* | 8/2010 | George | G04G 21/00 368/13 |
| 2011/0025499 | A1 | 2/2011 | Hoy et al. | |
| 2013/0335220 | A1 | 12/2013 | Scherer | |
| 2014/0044269 | A1* | 2/2014 | Anderson | H04R 5/04 381/57 |
| 2014/0070942 | A1* | 3/2014 | Haase | G08B 21/02 340/532 |
| 2015/0262245 | A1* | 9/2015 | Arvanitis | G06Q 30/02 705/14.35 |
| 2016/0269841 | A1* | 9/2016 | Shinde | G08B 1/08 |
| 2017/0004684 | A1 | 1/2017 | Slater | |
| 2017/0046944 | A1* | 2/2017 | Namazi | G08B 27/001 |
| 2017/0191843 | A1* | 7/2017 | Yadav | G01C 21/3461 |
| 2017/0206776 | A1* | 7/2017 | Linder | G08B 1/08 |
| 2017/0270775 | A1* | 9/2017 | Haase | G01S 11/14 |

OTHER PUBLICATIONS

Extended European Search Report from corresponding European Application No. 17151074.6 dated May 31, 2017.

* cited by examiner

SYSTEMS AND METHODS FOR ADAPTIVE DETECTION OF AUDIO ALARMS

BACKGROUND

Field of Invention

Embodiments of the present invention relate generally to systems and methods for adaptive detection of audio alarms and more specifically for systems and methods to learn newly presented audio alarms, analyze, and store for later use.

Discussion of Related Art

Audible alarms have been used since the invention of bells, horns and drums. Mechanical alarm clocks with bells have been used since the third century BC. Shop keeper's bells are still sold, and are now used on various doors to monitor the comings and goings of people.

However, in many applications bells have now been replaced with electronic buzzers. Such buzzers are ubiquitous in appliances and electronic equipment. Many other audible alarms beyond alarm clocks and door alarms exist in a place of business, public space, or household. Such alarms may include appliances such as a microwave oven, dishwasher, washing machine and stove. Smoke, fire, and carbon monoxide (CO) detectors may also be included in most business and public facilities, such as a library or public school. Use of audible alarms is one of the only methods for device manufacturers to communicate the state of the device or the occurrence of an event to the user. As a further example, many hospital and home medical devices today, responsible for the well being of humans only communicate with audible alarms.

Audible alarms may occur multiple times a day but rely on the assumption that a person is present to hear them to act on the information. Additionally, hearing impaired, or persons within a large facility, may not be able to hear these alarms even when at the same location. This can become a substantial limitation for the user who may feel the need to stay within proximity of a device in order to be aware of when an alarm sounds or an event occurs.

SUMMARY

Aspects of the present invention relate generally to systems and methods for adaptive detection of audio alarms. Embodiments of a system for adaptive detection of audio alarms comprise, a microphone configured to receive a series of sounds, a communications interface operably coupled to the microphone and configured to communicate with an external network, a memory configured to store a defined set of alarm templates, and a processor. Embodiments of the system allow the processor to be configured to analyze the received series of sounds for an alarm characteristic, compare the alarm characteristic analyzed to the defined set of alarm templates stored in the memory, store the compared alarm characteristic in the memory based on the defined set of alarm templates previously stored in the memory, and transmit an alert to a client device that an audio alarm has occurred.

Principles of the invention provide the system for adaptive detection of audio alarms where the processor is further configured to receive the series of sounds from a plurality of microphones, analyze the series of sounds received from a plurality of systems for adaptive detection of audio alarms, or analyze a plurality of alarm or background sound characteristics.

In alternate embodiments the processor is further configured to transmit an alarm template to a central library using the communications interface, receive user input at a client device to identify the audio alarm, replay the audio alarm at a client device for a user to identify, or execute a programmed action based on the alarm characteristic analyzed.

Embodiments of a method for adaptive detection of audio alarms comprises, receiving a series of sounds from a microphone, analyzing the received series of sounds for an alarm characteristic, comparing the analyzed alarm characteristic to a defined set of alarm templates stored in a memory, storing the compared alarm characteristic in the memory based on the defined set of alarm templates previously stored in the memory, and transmitting an alert to a client device that an audio alarm has occurred.

Principles of the invention provide the method for adaptive detection of audio alarms where receiving the series of sounds is from a plurality of microphones, analyzing the series of sounds received is performed by correlating a plurality of systems for adaptive detection of audio alarms, or comparing the alarm characteristic analyzed to the defined set of alarm templates stored in the memory is performed on a plurality of alarm or background sound characteristics.

Alternate embodiments provide transmitting an alarm template to a central library by a communications interface, comparing the analyzed alarm characteristic includes receiving input from a user at a client device to identify the audio alarm, comparing the analyzed alarm characteristic includes replaying the audio alarm for a user at a client device to identify the audio alarm, or analyzing the alarm characteristic automatically executes a programmed action.

Embodiments of a system for adaptive detection of audio alarms comprise, a microphone configured to receive a series of sounds, a processing device configured to receive and process the series of sounds and transmit an alert to a client device, and a client device configured to receive data from the processing device.

Principles of the invention provide the system for adaptive detection of audio alarms where the system is further configured to receive the series of sounds from a plurality of microphones, analyzing the series of sounds received from correlating a plurality of systems for adaptive detection of audio alarms, or receiving user input at a client device to identify the audio alarm.

BRIEF DESCRIPTION OF THE DRAWINGS

The accompanying drawings are not intended to be drawn to scale. In the drawings, each identical or nearly identical component that is illustrated in various figures is represented by a line numeral. For purposes of clarity, not every component may be labeled in every drawing. In the drawings.

DETAILED SUMMARY

This invention is not limited in its application to the details of construction and the arrangement of components set forth in the following descriptions or illustrated by the drawings. The invention is capable of other embodiments and of being practiced or of being carried out in various ways. Also, the phraseology and terminology used herein is for the purpose of descriptions and should not be regarded as limiting. The use of "including," "comprising," "having," "containing," "involving," and variations herein, are meant to be open-ended, i.e. "including but not limited to."

Devices today are generally equipped with various methods of communicating information to users. These methods may include very complex data streams transmitted wirelessly over long distances, or may be as simply elegant as a door chime to alert a shopkeeper to the presence of their customer. While some devices have the capability of transmitting complex data through a network interface, many, including life saving equipment in hospitals, do not. In many cases, even very complex systems are equipped with a device, such as a transducer, speaker, or piezo electric element, to create an audible alarm under the false assumption that a user will be present to act on the event or condition that caused the alarm to occur. In these cases, production of a sound may be signaling a range of conditions from a power sequence to a catastrophic event of the device that created the alarm. Principles of the invention allow for capture, analysis, and transmission of audible alarm information even when the intended user is not present to hear any alarm.

Figure 1:
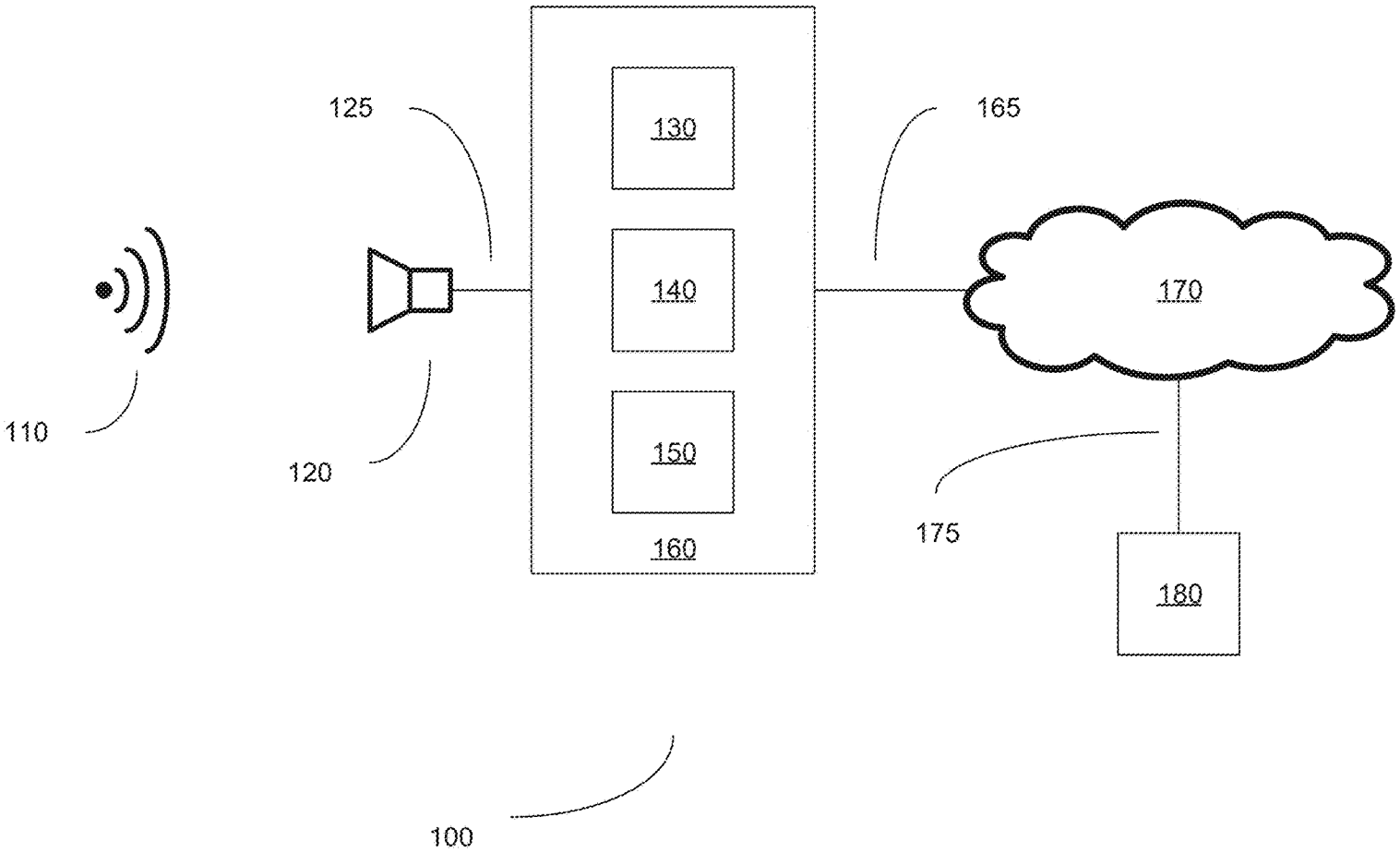
FIG. 1 is a diagram of a system for adaptive detection of audio alarms in accordance with embodiments of the invention.

It should be appreciated that the amount of variability in systems designed to capture and process information is enormous. FIG. 1 represents many exemplary systems for adaptive detection of audio alarms 100. Composition of one embodiment of the system may include a microphone 120 configured to receive a series of sounds 110. The microphone 120 may be configured to continuously detect audible sound or other vibrations and transform the received sounds into electrical signals. Such sounds are not limited to the range of human hearing and may be used to detect sounds in both the sub-sonic and ultra-sonic ranges. The microphone 120 may be of any type required for the particular application, including but not limited to, condenser, dynamic, carbon, piezoelectric, fiber optic, or laser type microphone 120 devices. It should be appreciated while a single microphone 120 is illustrated in FIG. 1, one or more microphones 120 may be used.

In accordance with on embodiment, the use of multiple microphones with a single processing unit allows a system to refine or determine with certainty the location of an alarm's source. Principles of the invention demonstrate embodiments of systems and methods for adaptive detection of audio alarms 100 to utilize multilateration techniques, known in the state of the art, to locate the origin of an alarm. Used in conjunction with other characteristics of an alarm such as frequency and amplitude, the system may refine both the alarm type and location.

As the received sounds are transformed into electrical signals by the microphone 120, they are transmitted across a sound input interface 125. This sound input interface 125 may be configured to allow the electrical signals transformed by the microphone 120 to be received by the processing unit 160. The sound input interface 125 may be configured by a wired or wireless connection manner. Wired connection types may include, but are not limited to, any physical cabling method such as category 5 cable, coaxial, fiber, copper, twisted pair, or any other physical media to propagate electrical signals from the microphone 120 to the processing unit 160. Wireless connections may include, but are not limited to Personal Area Networks (PAN), Local Area Networks (LAN), Wi-Fi, Bluetooth, cellular, global, or space based communication networks. The sound input interface 125 may be configured to accept input from one or more microphones 120.

A system for adaptive detection of audio alarms 100 may also contain a processing unit 160 which may consist of a processor 130, communications interface 140, and memory 150. The processing unit 160 may be a stand-alone, self contained microcontroller device, part of a cloud environment, a standalone general purpose computer, or any combination thereof as detailed in FIG. 6 and FIG. 7. Various embodiments include a stand-alone and self contained microcontroller device powered by battery or operatively connected directly to a power source such as an AC electrical outlet, USB charging port, or other DC power adaptor. Such an embodiment may allow the communication interface 140 to connect through a wireless interface and ultimately to a cloud environment 170. Alternate embodiments include the entire system on a single integrated circuit supported by other logic, or a communications interface 140 and processor 130 which may exist in the same physical enclosure, but the memory 150 may exist in a separate location. There are many variations of such a processing unit 160 known in the state of the art. FIG. 1 in no way should serve to limit the various implementations of such a system.

The system may produce data related to the operation of the processing unit 160 to be communicated over a network. Any network traffic produced by the processing unit 160 travels from communication interface 140 to the cloud 170 through a network connection 165. The cloud environment 170 comprises one or more computing nodes including, but not limited to, computer servers, disk storage, terminal servers, and appropriate infrastructure to support such equipment. One purpose of this environment may be to enter, store, manage, process, or output data in a remote environment rather than rely on locally accessible systems, servers or personal computers. This infrastructure may generally include considerations for power, cooling, storage, network access, security, and device management. Devices and infrastructure within this environment 170 may be grouped physically or virtually in one or more configurations to accommodate, public, private, hybrid, or other network topologies specific to the need of the environment itself. Access to the cloud computing environment 170 may also be gained by a variety of devices capable of connecting to such an environment known to the state of the art such as a network connection 165, 175.

A system for adaptive detection of audio alarms 100 may also contain one or more client devices 180 which are connected through a network connection 175. Such a client device 180 may exist in several embodiments. Examples include but are not limited to, a general purpose computer system with an interface able to convey information to a user, Personal Data Assistant (PDA), Mobile Telephone or any "Smart Phone" type of device. Any other wired or wireless device connected to a communications network 175 capable of receiving such a signal is also contemplated. Such devices, interfaces, and network types are known in the state of the art and should not be limited in any way for such an application.

Figure 2:
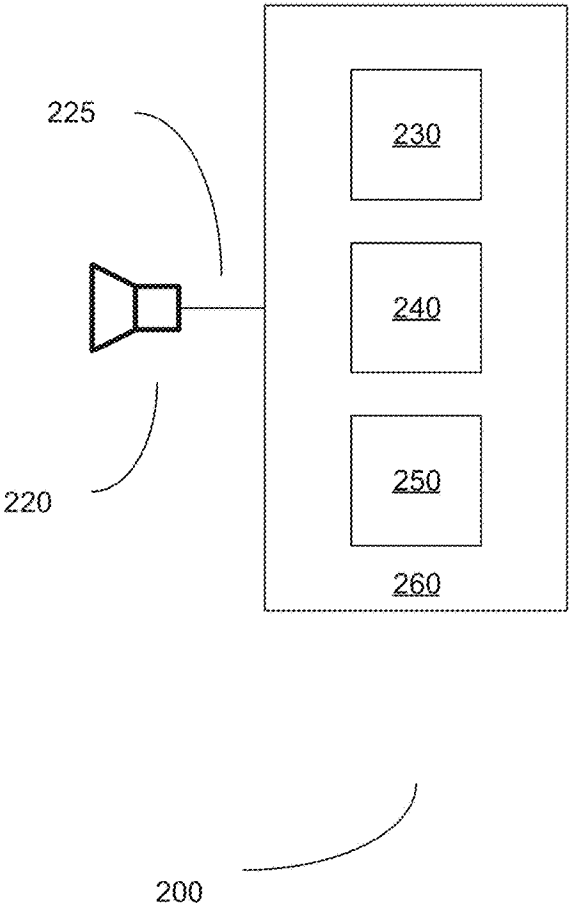
FIG. 2 is a diagram of a system for adaptive detection of audio alarms in accordance with alternate embodiments of the invention.

Turning now to FIG. 2, a detailed view of various alternate embodiments of a system for adaptive detection of audio alarms 200 is displayed. The system may contain a processing unit 260 which may consist of a processor 230, communications interface 240, and memory 250. One or more microphones 220 is connected to the processing unit 260 through a sound input interface 225. Network traffic travels from any networked data source, to the system through a network connection 165 and connected to the communications interface 240. The processing unit 260 may be a stand-alone, self contained microcontroller device, part of a cloud environment, a standalone general purpose computer, or any combination thereof as detailed in FIG. 6 and FIG. 7. In one of many possible embodiments all elements of FIG. 2 may be contained in a small enclosure which may be installed on an electrical outlet to provide power. Multiples of each component may exist to assist in collection of data, processing power, or storage capacity. All components may exist in separate locations, or the same physical enclosure.

Multiple systems may be deployed within a particular geographic location to refine the analysis of audible alarms for that location. Principles of the invention allow for the processors of deployed systems to be further configured to analyze the series of sounds from each individual system. These individual analyses are then correlated among the plurality of systems to refine the results of the analysis. It should be appreciated this analysis may take place in the processing unit 160, 260 of one or more devices. Alternatively each processing unit 160, 260 may transmit data through the communications interface 140, 240 to the cloud environment 170 through the network interface 165 to be processed. Once processed, the data returns to one or more processing units 160, 260 for any further action. It should be appreciated that processing performed within the cloud environment 170 may be performed on a general purpose computer as detailed in FIG. 6 and FIG. 7.

Figure 3:
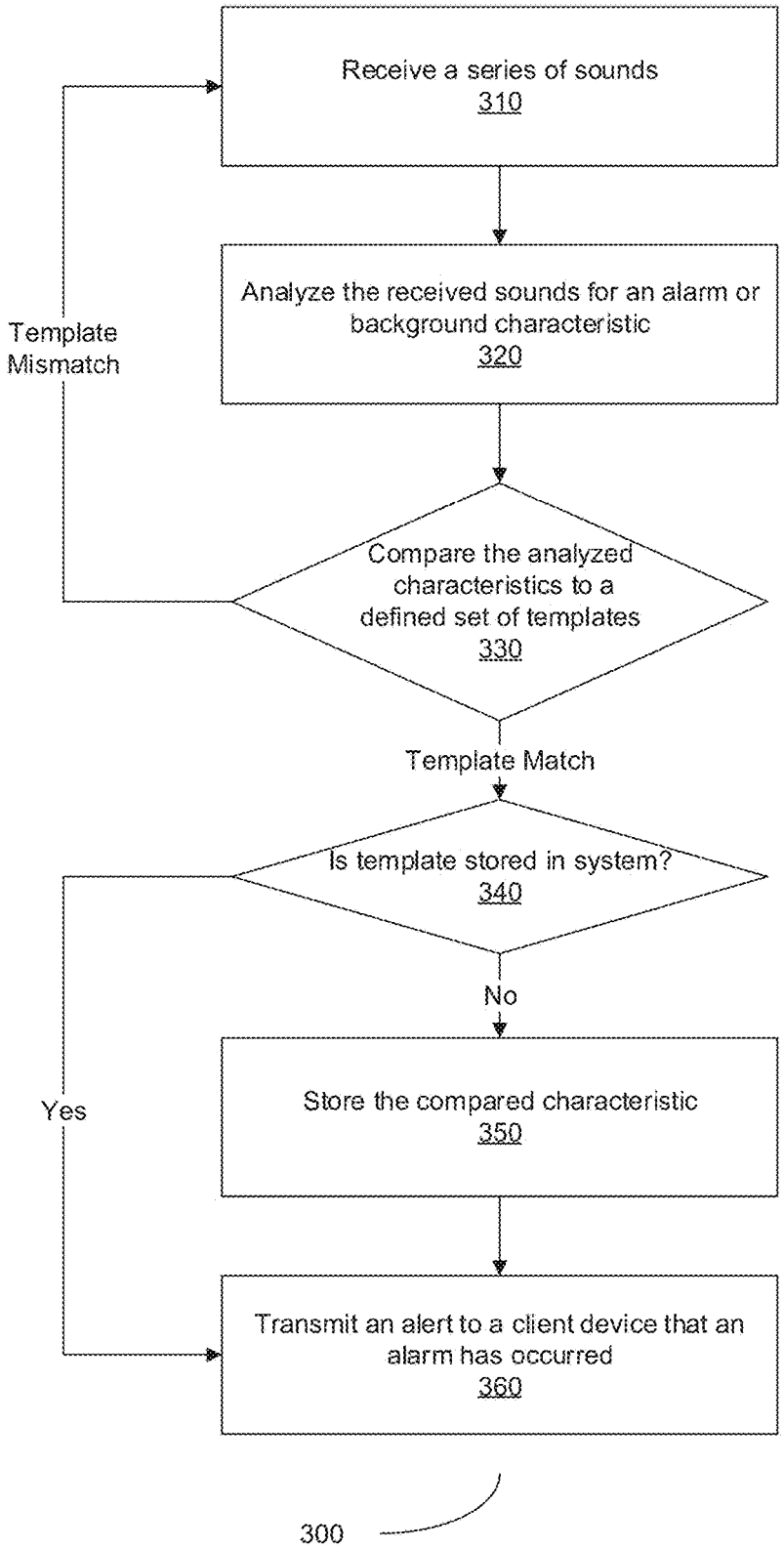
FIG. 3 is a flow diagram of embodiments of a process for adaptive detection of audio alarms in accordance with various embodiments of the invention.

Various embodiments allow for one or more microphones 220 and sound input interfaces 225 configured to be transmitted from a communications interface 240 to external servers which may contain the remainder of the processing of the system. Many variations of such a processing unit 260 and are known in the state of the art. In various embodiments the processing device 200 may be seen as the device which coordinates the processing and data collection for the system. Various embodiments of the processing unit 200 perform the computational operations to perform the various embodiments of the methods for adaptive detection of audio alarms 300 shown in FIG. 3.

A series of sounds, such as an alarm, are received 310 at one or more microphones 120, 220. These sounds may be within the range of typical human hearing, or outside of it, on either the lower or upper frequency band. A microphone 120, 220, transducer, or similar device able to receive the vibrations created by the sound and transform it into electrical signals are contemplated in embodiments of the system. It should be appreciated the system may be configured to receive sound continuously, periodically, or only during particular times. Such configuration may be necessary based on the application or system configuration and may be determined programmatically, by user configured input, or combination of both. As one of many examples, should the system for adaptive detection of audio alarms 100 operate with battery power only, it may be necessary to limit the operation of the system and availability to receive sound within particular times when sound may be expected. It should be appreciated various exemplary embodiments exist regarding configurations of the system operation.

As a series of sounds is received 310, the data is analyzed to determine if alarm or background sound characteristics within those received sounds exist 320. Principles of the invention allow the methods for adaptive detection of audio alarms 300 to recognize a wide array of sounds, alarms or audible warnings. Such alarms may include, but are not limited to, bells, horns, drums, glass break, appliance signal devices, smoke, CO, fire alarms, or doorbells. It should be appreciated that such alarms may occur in environments where the ambient noise level may vary over time and in some cases may be louder than the active alarm itself. Even in such cases it may be critical for a user to be alerted to the alarm and embodiments of the methods for adaptive detection of audio alarms 300 allow detection of alarms or audible warnings when mixed with ambient noise of various loudness.

To accomplish the analysis of the received sound 320, the processing unit 160, 260 executes signal processing algorithms to isolate the principle tones of the alarms or audible warnings and learns the temporal patterns of the principle tones. These algorithms include methods such as auto correlation or Fast Fourier Transform (FFT) for tonal identification and machine learning algorithms to learn the temporal sequence of tones. A user may train the processing unit 160, 260 by providing positive examples of an alarm and manually rejecting negative examples. Embodiments of such training data may include principle tones of an alarm, temporal patterns of an alarm, and relative loudness, or amplitude of alarm tones. It should be appreciated that the methods for adaptive detection of audio alarms 300 also allow for autonomous learning of alarms.

While alarms may be pre-loaded or autonomously learned by the system for adaptive detection of audio alarms 300, the system may also be taught by a user. Principles of the invention allow a user to present a series of sounds to a system for processing. If the system determines an alarm template does not exist for the presented series of sounds, the user may be presented with the option to add a new alarm template for inclusion into memory. Once saved, the new template may be available for detection. Embodiments of the invention allow for user configurability for particular alarm templates. As one of a variety of examples, a user may not wish to include glass break alarm templates for detection, or any other alarm templates which are associated with background sounds. It should be appreciated user configurability regarding selection of user profiles, system configurations, alarm templates, among other configurable parameters is contemplated as part of the invention.

Principles of the invention may identify various alarm or background sound characteristics which alone or in combination with other alarm or background sound characteristics, identifies a series of received sounds 310 as an alarm. Such characteristics may include, but are not limited to the frequency, amplitude, or period between sounds, patterns, or principal tones. Combinations of these characteristics may also be used to determine if a series of sounds is an alarm, distinctive features of an alarm, or merely ambient noise. As one of many examples, modern fire alarms in areas designed to protect sleeping accommodations, may produce an alarm with a frequency of 520 Hz, at 120 dB within 10 feet of the signaling device, utilizing a square wave pattern. Analysis of these received sounds 320 may determine this is distinctive features of an alarm or an alarm due to the alarm or background sound characteristics such as frequency, amplitude, and periodicity detectable by the system.

It should be appreciated; examples of audible alarms are multitudinous and include not only various alarm devices but variations of alarms within types. Devices may include, but are not limited to, smoke, fire, CO detectors, shop bells, and appliance buzzers, among others. Variations of alarms may include smoke detectors similar to above may produce an alarm with a frequency of 520 Hz, at 120 dB within 10 feet of the signaling device, utilizing a square wave pattern. Other smoke detectors may produce a T3 pattern with a frequency of 3000 Hz. Principles of the invention do not limit either the type of alarm device, or the various characteristics of alarm within each type of device.

Bells, percussion instruments, or any acoustic transducers are also contemplated as sources of alarms or distinctive features of alarms in embodiments of the invention. In such embodiments the tonal characteristics of individual bells may be identified and discerned from each other. As one example, should a shopkeeper have a distinct bell on each a front door, back door, and collar of a pet in the establishment, embodiments of the invention may distinguish each bell from the other.

Figure 4:
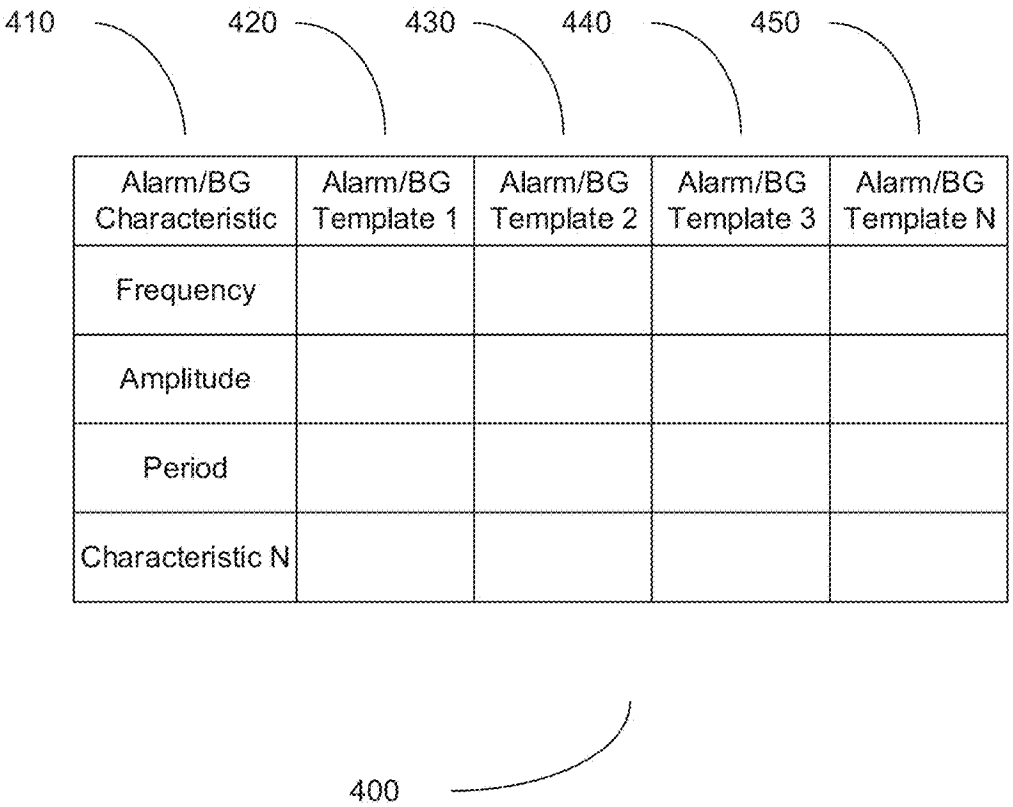
FIG. 4 is a table depicting alarm or background sound characteristics in accordance with various embodiments of the invention.

Once the received series of sounds 310 is analyzed for alarm or background sound characteristics 320, a comparison is performed to determine if any alarm or background sound characteristics match any defined alarm templates stored in the memory 330. These alarm templates are illustrated in FIG. 4 and may be stored in memory 130, 230 where each alarm template represents distinctive features of an alarm or audible warning. Such characteristics may be considered distinctive features of an alarm in addition to a known alarm. As detailed supra, each potential alarm will be determined to have one or more alarm or background sound characteristics to classify it as an alarm. It should be appreciated if the system is continuously receiving sounds, not all sounds, will be determined to have alarm or background sound characteristics. If no alarm or background sound characteristics are analyzed 320 from the audible signature received from the series of sounds 310, no match to any defined alarm templates will be found and the system will return to receiving a series of sounds 310. Various embodiments allow for one or more alarm or background sound characteristics to be analyzed determining if a match to any defined alarm templates exists. Combinations of multiple alarm or background sound characteristics may produce unique alarm templates.

Principles of the invention allow all sound to be captured and analyzed by the system. This includes not only any alarm which may occur, but also the background noise of the environment which is always occurring. With the background sound or ambient noise analyzed a level of the "noise floor" can be created. This "noise floor" level may be used during the analysis to further identify alarms that may occur. Removing, reducing, or otherwise augmenting an analysis of an alarm in conjunction with the "noise floor" may yield improved alarm detection. As one of many examples, if an environment possesses a background noise floor of 30 db (approximately the volume of a whisper quiet library at 6 feet) but also contains machinery that causes a 500 Hz tone at 50 db, these sounds may be captured, analyzed, and removed from any subsequent analysis of alarms within that environment. Separate defined background noise templates may also be created, learned, and applied within the system. It should be appreciated that the systems and methods used to determine and manipulate alarm sounds are equally applicable to background sounds.

FIG. 4 illustrates a table depicting alarm or background sound characteristics in accordance with various embodiments of the invention. A table of alarm or background sound characteristics 400 may exist in a memory within the system, external to the system and accessible through a network, or in an external memory, and catalog individual alarm or background sound characteristics. An index of alarm or background sound characteristics 410 individually or in combination define the distinctive features that an audible alarm or background noise may be composed of, or composition of an alarm, audible warning, or background itself. Elements to this table may be frequency (tone), amplitude (loudness), period (between sounds, patterns, or principal tones), or some combination thereof among other characteristics.

It should be appreciated the index of alarm or background sound characteristics 410 illustrated is not intended to be exhaustive. Embodiments of the invention demonstrate an alarm or background sound characteristics table 400 may exist in a wide variety of forms known to the state of the art. Also depicted may be the individual distinctive features of an alarm or alarms to a system, illustrated in FIG. 4 as "Template X", where "X" is an identifying number. It should be appreciated a system may have one 420 or more distinctive features of alarms, alarms, or background sound templates stored 430-450. There is no limit implied to the number of templates a system may maintain. Maintenance of this table may be used as a basis for storing new or modifying existing distinctive features of background sound, alarms or alarms in the system 100 or 200.

If during the comparison of the analyzed alarm or background sound characteristics to the stored alarm templates 330 a match to any defined alarm template exists, it may be determined that distinctive features to an audible alarm or an audible alarm may have occurred. It should be appreciated with analysis of sound in environments with varying ambient noise, false indicators may occur leading to the possibility of a "false positive" (incorrect alarming) or a "false negative" (missed alarm). Principles of the invention allow for reduction or elimination of such events based on the FFT equations used and the method of analysis of the received sound for alarm or background sound characteristics 320.

Principals of the invention allow various techniques to be used during the spectral analysis of the received sound. Such methods of spectral analysis may include, but are not limited to, Line Spectra Analysis, FFT, Linear Prediction, Filtering, Two Dimensional Spectra Analysis, and Spectrograms. Embodiments of the invention may use search algorithms in particular frequency bands for a pattern of tones within that selected frequency band. As a result, any background sound or ambient noise in any other frequency bands may be discarded. Frequencies of varying bands may require specific additional analysis for characteristics specific to those frequencies.

Once a match of analyzed alarm or background sound characteristics to a defined alarm template 330 has occurred, a further analysis may be performed to determine if the particular analyzed alarm or background sound characteristics are stored in the system 340. If the analyzed alarm or background sound characteristics are not a previously defined template, it may be stored to the memory autonomously. Embodiments of the invention allow for a sample of the received sound to be communicated to a client device 180 which may allow an end user to determine if the analyzed alarm or background sound characteristics should be stored to the system. It should be appreciated that a user may annotate alarm templates with characteristics such as name, title, or other defining elements at any time during the storage process.

Once it has been determined that the alarm or background sound characteristics should be stored to the system 340, the system may store the alarm template 420-450 to the memory 150. 250. It should be appreciated the methods for adaptive detection of audio alarms 300 allow for alarm templates to be pre-loaded into a system to allow the system to be useful to a user from first use without any previous training of sounds. Further, principles of the invention contemplate storage of alarm templates within the memory 150 of the processing unit 160 as well as remote storage and processing of alarm or background sound characteristics at a central repository or processing facility that may be accessed by the communication interface 140, 240 in the cloud 170.

If an alarm or distinctive features of an alarm have been determined by the methods for adaptive detection of audio alarms 300, to make a user aware that an event may have occurred which caused an alarm, an alert may be transmitted to a client device 180 informing a user 360. This transmission may occur from the processing unit 160, 260 through the communications interface 140, 240 via the network 165, 175 to the client device 180. In an alternate embodiment the processing unit itself 160, 260 may serve as the client in the absence or in addition to other clients. In such a case embodiments of the system may include a speaker to produce sound or a visual indicator to produce visible light to alert a user of an alarm or other condition.

In several exemplary embodiments user alerts may be transmitted to client devices such as wireless handheld devices to allow a user immediate notification to an audible alarm. Methods for "pushing" data such as user alerts to such devices are multitudinous in the state of the art. These client devices 180 need not be wireless or handheld in nature to receive such alerts. It should be appreciated any computer system capable of receiving data may be capable of receiving such an alert.

Various embodiments of the invention allow for varying degrees of processing to be conducted externally with resources in the cloud 170. While embodiments of the systems and method for adaptive detection of audio alarms may run autonomously and self contained providing analysis and user notification without other processing ability, any amount of processing may also be conducted with remote resources such as those contemplated in the cloud 170. In such embodiments each processing unit 160, 260 may transmit data through the communications interface 140, 240 to the cloud environment 170 through the network interface 165 to be processed by an external resource. Once processed, the data returns to one or more processing units 160, 260 for any further action or to a communication interface or device for the purpose of notifying a user. It should be appreciated any processing performed within the cloud environment 170 may be performed on a general purpose computer or specially configured compute as detailed in FIG. 6 and FIG. 7.

Figure 5:
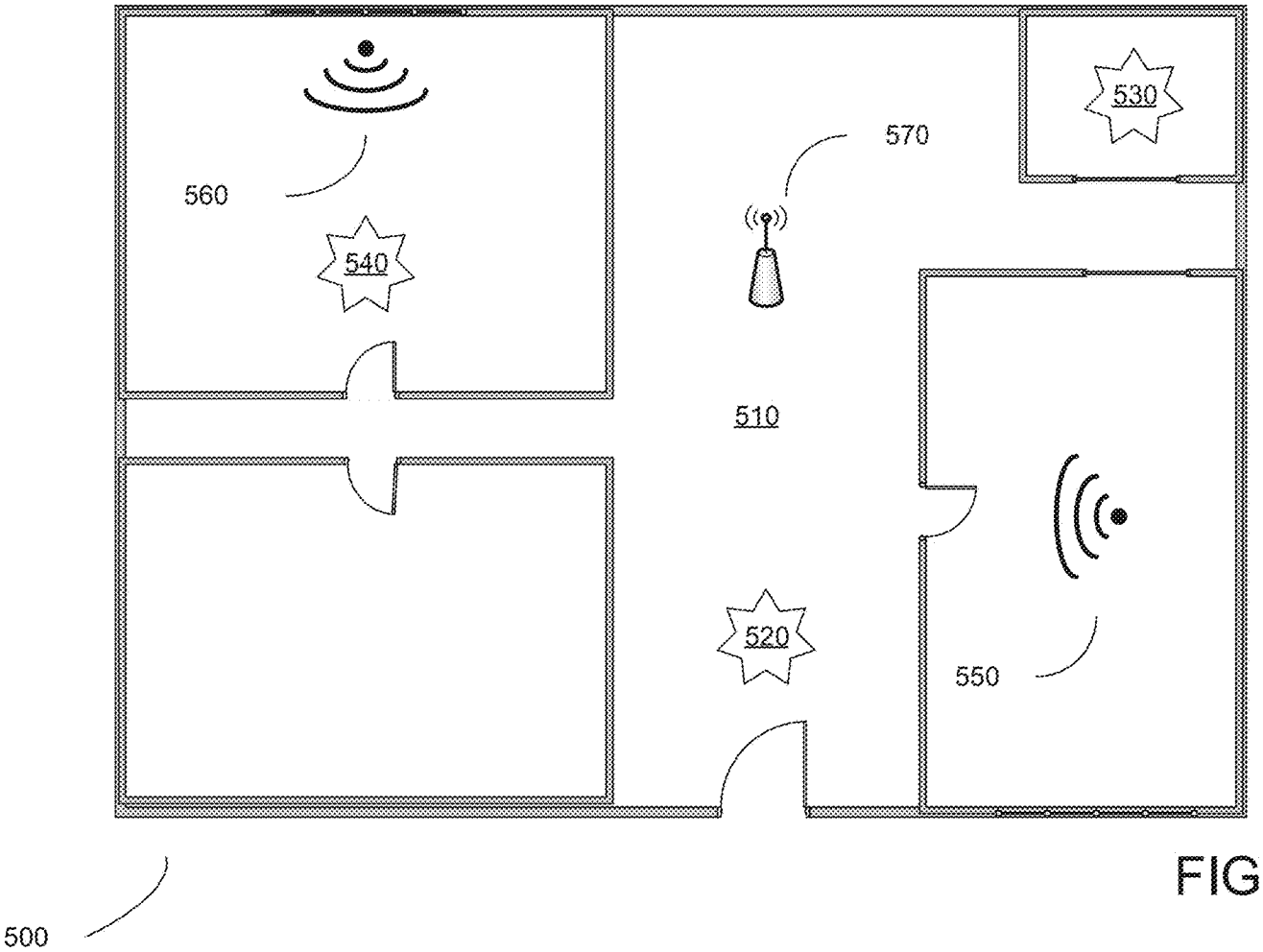
FIG. 5 is a diagram of a system for adaptive detection of audio alarms in accordance with embodiments of the invention.

Several exemplary embodiments in context are illustrated in FIG. 5, 500. A dwelling 510 may have several systems for adaptive detection of audio alarms deployed in various locations throughout the dwelling. Various embodiments allow for multiple systems as well as a single system with one or more microphones to receive sounds. It should be appreciated a dwelling 510 may take on any variety of configurations such as a home, apartment, office space, or similar and should not be limited to the configuration illustrated in FIG. 5.

Within the dwelling 510 various systems for the adaptive detection of audio alarms 520, 530, 540 may be deployed. It should be appreciated multiple systems may be co-located at the same location and of any type or quantity. In one of many embodiments a single sensing unit may be located in a location anticipated to receive more sound than others, such as a hallway, and transmit information to an external network. A wired or wireless network gateway 570 exists within the dwelling 510 to receive data from the various systems for the adaptive detection of audio alarms 520, 530, 540 and transmit to the external network. Each individual system or collection of systems may have the ability to transmit data through a communications interface in a wired or wireless fashion. Each individual system may relay information through the wired or wireless network gateway 570 for processing in the cloud and processed data for action may be returned to the individual systems.

One embodiment may include a system in the main hall of a dwelling 520 which receives sound from a variety of sources such as a door where the system may be trained to recognize the ringing of a bell attached to the door or other sounds to indicate a forced ingress, possibly indicating an intruder. Sounds would be processed within the system itself, or sent to an external interface through a local network gateway 570 to an external network 120 and processed by a remote processing unit. Any resulting distinctive features of an alarm or alarm would be analyzed, compared, stored and routed to appropriate users by the processing unit 160, 260, or a remote processing unit. Any resulting user notifications would be communicated through a network 165, 175 to the assigned client 180. While a single system may be used to determine any alarms or distinctive features of alarms, a correlation of a plurality of systems may be possible to refine the series of sounds and subsequently the associated alert transmitted to the user. A plurality of microphones associated with a single system, for example the system in the main hall 520, or a plurality of systems may also be configured.

An alternate embodiment may include multiple systems such as one system 520 in a front hall and another system 540 in a bedroom. In such an example, should an intruder enter the window of the bedroom, both the bedroom system 540 and front hall system 520 may detect sound from the entry. In such a case both systems may process the sound of a window breaking. If an existing alarm template of that type exists, a user would be notified of a "glass break." If no such alarm template exists principles of the invention allow for the system to be configured to detect such sounds and contact a user with a notification should it occur. In this case, the system may contact the user to verify if an alarm has occurred and embodiments of the invention even allow the end user to hear the sound that just occurred.

Once processed, the individual systems may correlate with each other and using principles of multilateration determine the sound of glass breaking was closer to the bedroom than it was the front hall, possibly indicating a window in the bedroom was broken and an intruder may be entering the home. Once the user is alerted to this information, the individual may take any action they deem appropriate.

In another example within an office setting, multiples systems such as in a front hall 520, kitchen 540 and server room 530 are deployed. If in this example, both a smoke alarm 560 and a CO alarm 550 are sounding, each system if able to hear the alarm may be able to detect the types of alarm and report same to the user. Once processed, the individual systems again may correlate with each other and using principles of multilateration determine the sound of the smoke alarm was closer to the kitchen than it was the front hall or server room. This may possibly indicate a fire or other serious thermal event in the kitchen and a developing issue with the presence of CO in an office adjacent to the main hall and the server room.

It should be appreciated that while various embodiments may result in action to be taken by a user for an audible alarm, it should also be appreciated that portions of the system itself may autonomously take the physical action. From above, once the user is alerted to this information, the individual may take any action they deem appropriate such as calling the fire department. Also, principles of the invention allow for autonomous action such as, but not limited to, shutting down the servers in the server room, deploying a fire suppression system, or opening all doors which are normally locked in anticipation of the fire department arriving. While such automated control systems, such as fire control systems, door security systems, and server control, among several others, are available and known in the state of the art, principles of the invention may allow for their use in conjunction with systems and methods for adaptive detection of audio alarms which may allow for automatic physical control actions within environment.

Any computer systems used in various embodiments may be, for example, computers such as those based on Intel PENTIUM-type processor, Motorola PowerPC, Sun UltraSPARC, Hewlett-Packard PA-RISC processors, or any other type of processor.

Figure 6:
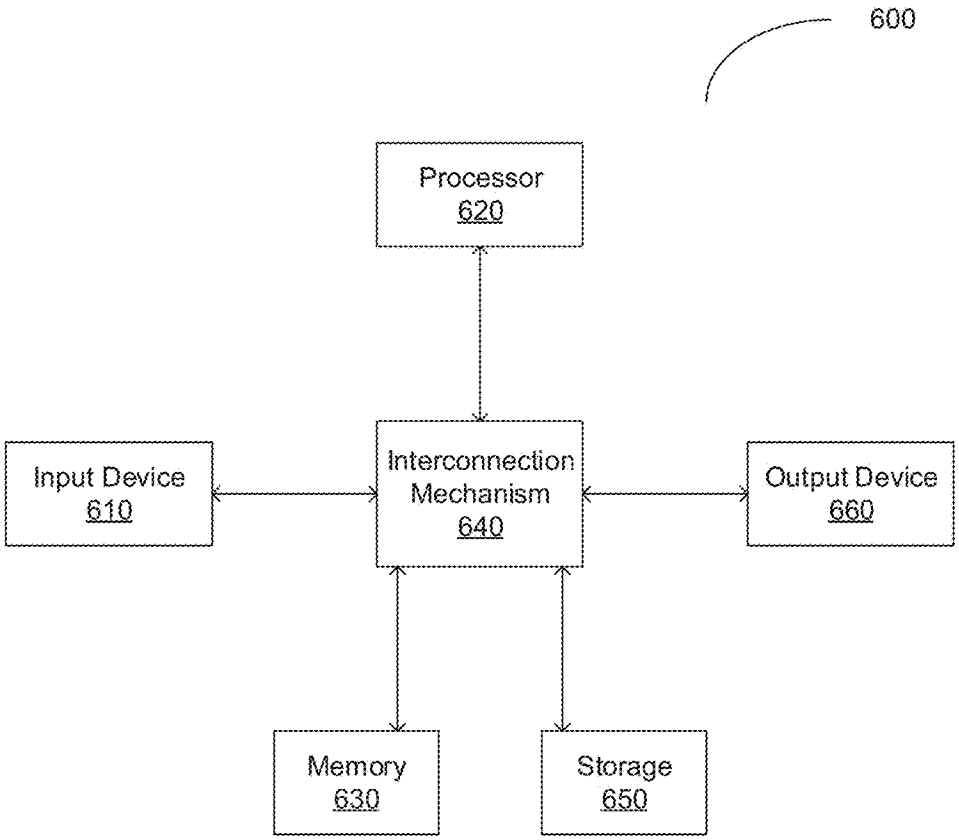
FIG. 6 is a functional block diagram of a computer system in accordance with embodiments of the invention.

For example, various embodiments of the invention may be implemented as specialized software executing in a computer system 600 such as that shown in FIG. 6. The computer system 600 may include a processor 620 connected to one or more memory devices 630, such as a disk drive, memory, or other device for storing data. Memory 630 is typically used for storing programs and data during operation of the computer system 600. The computer system 600 may also include a storage system 650 that provides additional storage capacity. Components of computer system 600 may be coupled by an interconnection mechanism 640, which may include one or more busses (e.g., between components that are integrated within the same machine) and/or a network (e.g., between components that reside on separate discrete machines). The interconnection mechanism 640 enables communications (e.g., data, instructions) to be exchanged between system components of system 600.

Computer system 600 also includes one or more input devices 610, for example, a keyboard, mouse, trackball, microphone, touch screen, and one or more output devices 660, for example, a printing device, display screen, speaker. In addition, computer system 600 may contain one or more interfaces (not shown) that connect computer system 600 to a communication network (in addition or as an alternative to the interconnection mechanism 640).

Figure 7:
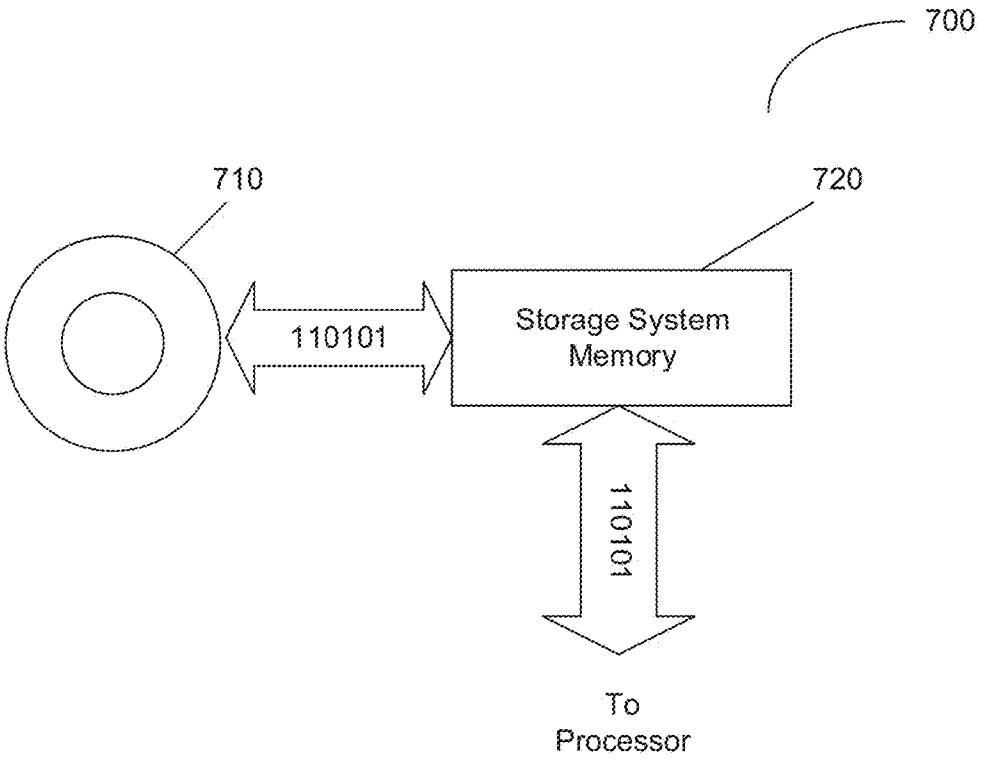
FIG. 7 is a functional block diagram of a storage system in accordance with the computer system of FIG. 6.

The storage system 650, shown in greater detail in FIG. 7, typically includes a computer readable and writeable nonvolatile recording medium 710 in which signals are stored that define a program to be executed by the processor or information stored on or in the medium 710 to be processed by the program to perform one or more functions associated with embodiments described herein. The medium may, for example, be a disk or flash memory. Typically, in operation, the processor causes data to be read from the nonvolatile recording medium 710 into another memory 720 that allows for faster access to the information by the processor than does the medium 710. This memory 720 is typically a volatile, random access memory such as a dynamic random access memory (DRAM) or static memory (SRAM). It may be located in storage system 700, as shown, or in memory system 630. The processor 620 generally manipulates the data within the integrated circuit memory 630, 720 and then copies the data to the medium 710 after processing is completed. A variety of mechanisms are known for managing data movement between the medium 710 and the integrated circuit memory element 630, 720, and the invention is not limited thereto. The invention is not limited to a particular memory system 630 or storage system 650.

The computer system may include specially-programmed, special-purpose hardware, for example, an application-specific integrated circuit (ASIC). Aspects of the invention may be implemented in software, hardware or firmware, or any combination thereof. Further, such methods, acts, systems, system elements and components thereof may be implemented as part of the computer system described above or as an independent component.

Although computer system 600 is shown by way of example as one type of computer system upon which various aspects of the invention may be practiced, it should be appreciated that aspects of the invention are not limited to being implemented on the computer system as shown in FIG. 7. Various aspects of the invention may be practiced on one or more computers having a different architecture or components shown in FIG. 7. Further, where functions or processes of embodiments of the invention are described herein (or in the claims) as being performed on a processor or controller, such description is intended to include systems that use more than one processor or controller to perform the functions.

Computer system 600 may be a computer system that is programmable using a high-level computer programming language. Computer system 600 may be also implemented using specially programmed, special purpose hardware. In computer system 600, processor 620 is typically a commercially available processor such as the well-known Pentium class processor available from the Intel Corporation. Many other processors are available. Such a processor usually executes an operating system which may be, for example, the Windows 95, Windows 98, Windows NT, Windows 2000 (Windows ME) or Windows XP or Vista operating systems available from the Microsoft Corporation, MAC OS System X operating system available from Apple Computer, the Solaris operating system available from Sun Microsystems, or UNIX operating systems available from various sources. Many other operating systems may be used.

The processor and operating system together define a computer platform for which application programs in high-level programming languages are written. It should be understood that embodiments of the invention are not limited to a particular computer system platform, processor, operating system, or network. Also, it should be apparent to those skilled in the art that the present invention is not limited to a specific programming language or computer system. Further, it should be appreciated that other appropriate programming languages and other appropriate computer systems could also be used.

One or more portions of the computer system may be distributed across one or more computer systems coupled to a communications network. For example, as discussed above, a computer system that determines available power capacity may be located remotely from a system manager. These computer systems also may be general-purpose computer systems. For example, various aspects of the invention may be distributed among one or more computer systems configured to provide a service (e.g., servers) to one or more client computers, or to perform an overall task as part of a distributed system. For example, various aspects of the invention may be performed on a client-server or multi-tier system that includes components distributed among one or more server systems that perform various functions according to various embodiments of the invention. These components may be executable, intermediate (e.g., IL) or interpreted (e.g., Java) code which communicate over a communication network (e.g., the Internet) using a communication protocol (e.g., TCP/IP). For example, one or more database servers may be used to store device data, such as expected power draw, that is used in designing layouts associated with embodiments of the present invention.

It should be appreciated that the invention is not limited to executing on any particular system or group of systems. Also, it should be appreciated that the invention is not limited to any particular distributed architecture, network, or communication protocol.

Various embodiments of the present invention may be programmed using an object-oriented programming language, such as SmallTalk, Java, C++, Ada, or C# (C-Sharp). Other object-oriented programming languages may also be used. Alternatively, functional, scripting, and/or logical programming languages may be used. Various aspects of the invention may be implemented in a non-programmed environment (e.g., documents created in HTML, XML or other format that, when viewed in a window of a browser program render aspects of a graphical-user interface (GUI) or perform other functions). Various aspects of the invention may be implemented as programmed or non-programmed elements, or any combination thereof.

Embodiments of a systems and methods described above are generally described for use in relatively large data centers having numerous equipment racks; however, embodiments of the invention may also be used with smaller data centers and with facilities other than data centers. Some embodiments may also be a very small number of computers distributed geographically so as to not resemble a particular architecture.

In embodiments of the present invention discussed above, results of analyses are described as being provided in real-time. As understood by those skilled in the art, the use of the term real-time is not meant to suggest that the results are available immediately, but rather, are available quickly giving a designer the ability to try a number of different designs over a short period of time, such as a matter of minutes.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A system for adaptive detection of audio alarms, comprising:

a microphone configured to receive a series of sounds;

a communications interface operably coupled to the microphone and configured to communicate with an external network;

a memory configured to store a defined set of alarm templates; and a processor operably coupled to the memory and the communications interface and configured to:

analyze the series of sounds to determine an alarm characteristic;

compare the alarm characteristic to the defined set of alarm templates stored in the memory;

store the compared alarm characteristic in the memory based on the defined set of alarm templates previously stored in the memory;

transmit an alert to a client device that an audio alarm has occurred;

receive user input from a client device and identify the audio alarm based on the user input; and generate and store in the memory an alarm template for the alarm characteristic based on the user input.

2. The system for adaptive detection of audio alarms of claim 1, wherein the processor is further configured to receive series of sounds from a plurality of microphones.

3. The system for adaptive detection of audio alarms of claim 1, wherein the processor is further configured to analyze a series of sounds from a plurality of systems for adaptive detection of audio alarms.

4. The system for adaptive detection of audio alarms of claim 1, wherein the processor is further configured to analyze background sound characteristics.

5. The system for adaptive detection of audio alarms of claim 1, wherein the processor is further configured to transmit an alarm template to a central library using the communications interface and to receive an alarm template from the central library using the communication interface.

6. The system for adaptive detection of audio alarms of claim 1, wherein the processor is further configured to replay the audio alarm at a client device.

7. The system for adaptive detection of audio alarms of claim 1, wherein the processor automatically executes a programmed action based on the alarm characteristic.

8. A method for adaptive detection of audio alarms, comprising:

receiving, at a processor, a series of sounds from a microphone;

analyzing, at the processor, the series of sounds to determine an alarm characteristic;

comparing, at the processor, the alarm characteristic to a defined set of alarm templates stored in a memory;

storing, at the processor, the compared alarm characteristic in the memory based on the defined set of alarm templates previously stored in the memory;

transmitting, at the processor, an alert to a client device that an audio alarm has occurred;

receiving user input at a client device and identifying the audio alarm based on the user input; and generating and storing in the memory an alarm template for the alarm characteristic based on the user input.

9. The method for adaptive detection of audio alarms of claim 8, further comprising receiving a series of sounds from a plurality of microphones.

10. The method for adaptive detection of audio alarms of claim 8, wherein analyzing the series of sounds received is performed by correlating a plurality of systems for adaptive detection of audio alarms.

11. The method for adaptive detection of audio alarms of claim 8, further comprising detecting and analyzing background sound characteristics.

12. The method for adaptive detection of audio alarms of claim 8, wherein transmitting an alarm template to and from a central library is performed by a communications interface.

13. The method for adaptive detection of audio alarms of claim 8, wherein comparing the alarm characteristic includes replaying the audio alarm for a user at a client device to identify the audio alarm.

14. The method for adaptive detection of audio alarms of claim 8, wherein analyzing the alarm characteristic includes automatically executing a programmed action.

15. A system for adaptive detection of audio alarms, comprising:

a microphone configured to receive a series of sounds;

a processing device coupled to the microphone and configured to receive and process the series of sounds and transmit an alert to a client device; and a client device configured to receive data from the processing device, and configured to identify an audio alarm associated with the series of sounds based on input received from a user, and transmit the identity of the audio alarm to the processing device;

wherein the processing device is further configured to generate and store an alarm template based on the identity of the audio alarm.

16. The system for adaptive detection of audio alarms of claim 15, wherein the system is further configured to receive the series of sounds from a plurality of microphones.

17. The system for adaptive detection of audio alarms of claim 15, wherein the system is further configured to analyze a series of sounds received from a plurality of systems for adaptive detection of audio alarms.

* * * * *